US009004178B2

(12) United States Patent
Leuchtenberg

(10) Patent No.: US 9,004,178 B2
(45) Date of Patent: Apr. 14, 2015

(54) BLOWOUT PREVENTER ASSEMBLY

(75) Inventor: Christian Leuchtenberg, Singapore (SG)

(73) Assignee: Managed Pressure Operations PTE Ltd., Singapore (SG)

( * ) Notice: Subject to any disclaimer, the term of this patent is extended or adjusted under 35 U.S.C. 154(b) by 246 days.

(21) Appl. No.: 13/443,332

(22) Filed: Apr. 10, 2012

(65) Prior Publication Data

US 2013/0233562 A1 Sep. 12, 2013

(30) Foreign Application Priority Data

Mar. 12, 2012 (GB) ..... 1204310.5

(51) Int. Cl.
*E21B 33/064* (2006.01)
*E21B 34/04* (2006.01)

(52) U.S. Cl.
CPC ..... *E21B 33/064* (2013.01); *E21B 34/04* (2013.01)

(58) Field of Classification Search
CPC .... E21B 34/04; E21B 33/064; E21B 33/0355
USPC ..... 166/345, 363, 86.2, 84.3, 373; 137/315.02; 251/1.1–1.3
See application file for complete search history.

(56) References Cited

U.S. PATENT DOCUMENTS 2,609,836 A * 9/1952 Knox ..... 277/327
2,731,281 A 1/1956 Knox
3,044,481 A 7/1962 Regan
3,128,077 A 4/1964 Lucky
3,225,831 A 12/1965 Knox
3,299,957 A 1/1967 O'Neill et al.
3,323,773 A * 6/1967 Walker ..... 251/1.2
3,561,723 A 2/1971 Cugini
3,651,823 A 3/1972 Milsted, Sr.

(Continued)

FOREIGN PATENT DOCUMENTS

EP 1659260 A2 5/2006
GB 326615 A 3/1930

(Continued)

OTHER PUBLICATIONS

International Search Report for GB1204310.5 dated Jul. 2, 2012, 2 pages.

(Continued)

*Primary Examiner* — Matthew Buck
(74) *Attorney, Agent, or Firm* — Bracewell & Giuliani LLP; Constance Gall Rhebergen; Linda L. Morgan

(57) ABSTRACT

A blowout preventer assembly comprising a blowout preventer and control apparatus, the blowout preventer comprising a housing a sealing element and a fluid pressure operated actuator mounted in the housing, the actuator 18 dividing the interior of the housing into two chambers, namely an open chamber and a close chamber, substantially preventing flow of fluid between the two chambers, and being movable, by means of the supply of pressurized fluid to the close chamber, to urge the sealing element into sealing engagement with a drill pipe extending through the blow out preventer, the control apparatus including a close line which extends from the exterior of the housing to the close chamber, and a source of pressurized fluid which is connected to the close line, wherein the source of pressurized fluid is located adjacent to the housing.

19 Claims, 3 Drawing Sheets

(56) References Cited

U.S. PATENT DOCUMENTS

| | | | | |
|---|---|---|---|---|
| 3,667,721 | A * | 6/1972 | Vujasinovic | 51/1.1 |
| 3,695,349 | A * | 10/1972 | Murman et al. | 166/352 |
| 4,095,421 | A * | 6/1978 | Silcox | 60/398 |
| 4,098,341 | A * | 7/1978 | Lewis | 166/387 |
| 4,317,557 | A * | 3/1982 | Orr | 251/1.2 |
| 4,509,405 | A | 4/1985 | Bates | |
| 4,614,148 | A * | 9/1986 | Bates | 91/420 |
| 4,626,135 | A * | 12/1986 | Roche | 405/224.2 |
| 4,832,126 | A * | 5/1989 | Roche | 166/358 |
| 4,858,882 | A * | 8/1989 | Beard et al. | 251/1.2 |
| 4,923,008 | A * | 5/1990 | Wachowicz et al. | 166/373 |
| 6,192,680 | B1 * | 2/2001 | Brugman et al. | 60/398 |
| 6,655,405 | B2 * | 12/2003 | Hollister et al. | 137/102 |
| 2002/0100589 | A1 | 8/2002 | Childers et al. | |
| 2008/0185046 | A1 * | 8/2008 | Springett et al. | 137/14 |
| 2008/0267786 | A1 * | 10/2008 | Springett et al. | 417/53 |
| 2011/0005770 | A1 | 1/2011 | Scranton et al. | |
| 2011/0088913 | A1 * | 4/2011 | Baugh | 166/374 |
| 2011/0100637 | A1 | 5/2011 | Gustafson | |
| 2011/0131964 | A1 | 6/2011 | Kocurek et al. | |
| 2012/0111572 | A1 * | 5/2012 | Cargol, Jr. | 166/363 |

FOREIGN PATENT DOCUMENTS

| | | | |
|---|---|---|---|
| GB | 627196 | A | 8/1949 |
| GB | 1294288 | A | 10/1972 |
| RU | 2198282 | C2 | 2/2003 |
| WO | 2009132300 | A2 | 10/2009 |
| WO | 2011128690 | A1 | 10/2011 |

OTHER PUBLICATIONS

International Search Report issued in related International Patent Application No. PCT/EP2013/055043; dated May 14, 2014; 4 pages.

* cited by examiner

BLOWOUT PREVENTER ASSEMBLY

RELATED APPLICATIONS

This application claims priority to and benefit of GB Patent Application No. 1204310.5, filed Mar. 12, 2012, which is incorporated herein in its entirety.

FIELD OF THE INVENTION

The invention relates to a blowout preventer assembly, particularly but not exclusively, an annular blowout preventer for use in the drilling of a wellbore into a subterranean fluid reservoir and/or the production of fluid, typically hydrocarbon fluids, from such a reservoir.

DESCRIPTION OF THE PRIOR ART

The drilling of a borehole or well is typically carried out using a steel pipe known as a drill pipe or drill string with a drill bit on the lowermost end. The drill string comprises a series of tubular sections, which are connected end to end. The entire drill string is typically rotated using a rotary table mounted on top of the drill pipe, and as drilling progresses, a flow of mud is used to carry the debris created by the drilling process out of the wellbore. Mud is pumped down the drill string to pass through the drill bit, and returns to the surface via the annular space between the outer diameter of the drill string and the wellbore (generally referred to as the annulus). For a subsea well bore, a tubular, known as a riser, extends from the rig to the top of the wellbore and provides a continuous pathway for the drill string and the fluids emanating from the well bore. In effect, the riser extends the wellbore from the sea bed to the rig, and the annulus also comprises the annular space between the outer diameter of the drill string and the riser.

The use of a blow out preventer (BOP) to seal, control and monitor oil and gas wells is well known, and these are used on both land and off-shore rigs. During drilling of a typical high-pressure wellbore, the drill string is routed through a BOP stack toward a reservoir of oil and/or gas. The BOP is operable, in the event of a sudden influx of formation fluid into the wellbore (a kick) to seal around the drill string, thus closing the annulus and stopping tools and formation fluid from being blown out of the wellbore (a blowout). The BOP stack may also be operable to sever the drill string to close the wellbore completely. Two types of BOP are in common use—ram and annular, and a BOP stack typically includes at least one of each type. The original design of annular BOP is disclosed in U.S. Pat. No. 2,609,836.

A typical BOP has a sealing element and a fluid pressure operated actuator mounted in a housing. The actuator divides the interior of the housing into two chambers (an "open chamber" and a "close chamber"), and substantially prevents flow of fluid between the two chambers. The actuator is movable, by means of the supply of pressurised fluid to the close chamber, to urge the sealing element into sealing engagement with a drill pipe extending through the BOP (the closed position), and, by means of the supply of pressurised fluid to the open chamber, to release the sealing element from sealing engagement with the drill pipe (the open position). Certain types of BOP are configured such that, when there is no drill pipe in the BOP, the sealing element can close on itself to close completely the BOP stack, and thus also the wellbore.

The supply of pressurised fluid for actuation of the BOP typically comprises a pump which is operable to pump fluid into an accumulator via a line containing a non-return valve.

Fluid flow lines are provided to connect the accumulator to the open chamber and the close chamber and at least one valve is provided to control flow of fluid from the accumulator to the open or close chamber.

An example of a typical annular BOP and fluid pressure control system is shown in U.S. Pat. No. 4,098,341. Alternative embodiments of BOP and their control systems are disclosed in U.S. Pat. No. 3,044,481, U.S. Pat. No. 3,299,957, U.S. Pat. No. 4,614,148 and U.S. Pat. No. 4,317,557.

U.S. Pat. No. 3,128,077 discloses a further alternative BOP operating system in which the downhole pressure created by a blowout is used to assist in closing the BOP.

In order to prevent a blowout from occurring, it is important that the BOP can be closed as quickly as possible, to ensure that the annulus or wellbore is closed as soon as possible after a kick is detected.

U.S. Pat. No. 4,317,557 discloses the use of an auxiliary BOP closing system in addition to a conventional BOP control system, which may be operated to close the BOP should the main system fail or malfunction. The source of pressurised fluid for the auxiliary closing system is independent from the source of pressurised fluid for the main control system, and in the example given comprises at least one bottle of compressed nitrogen gas which can supply 2340 psi of pressure to the close chamber, and it is claimed that the auxiliary closing system can close a 10 inch annular BOP in less than 20 seconds.

It is an object of the present invention to provide an alternative configuration of apparatus for operating a BOP which provides for rapid closing of the BOP.

SUMMARY OF THE INVENTION

According to a first aspect of the invention we provide a blow out preventer assembly comprising a blow out preventer and control apparatus, the blowout preventer comprising a housing, a sealing element, and a fluid pressure operated actuator mounted in the housing, the actuator dividing the interior of the housing into two chambers, namely an open chamber and a close chamber, substantially preventing flow of fluid between the two chambers, and being movable, by means of the supply of pressurised fluid to the close chamber, to urge the sealing element into sealing engagement with a drill pipe extending through the blow out preventer, the control apparatus including a close line which extends from the exterior of the housing to the close chamber, and a source of pressurised fluid which is connected to the close line, wherein the source of pressurised fluid is located adjacent to the housing.

The source of pressurised fluid preferably comprises at least one accumulator.

Advantageously, the control apparatus further comprises a close control valve which is located in the close line between the source of pressurised fluid and the close chamber, the close control valve being movable between an open position in which flow of fluid from the source of pressurised fluid to the close chamber is permitted, and a closed position in which flow of fluid from the source of pressurised fluid to the close chamber is substantially prevented.

The close control valve is preferably electrically or electronically operable. In this case, the control valve may move from the closed to position to the open position when supplied with electrical power.

Supply of electrical power to the close control valve may be controlled by an electronic control unit which is remote from the blow out preventer and control apparatus.

The control apparatus may further comprise a pump which has an inlet which draws fluid from a fluid reservoir and an outlet which is connected to the close line.

The control apparatus may further comprise an open line which extends from the exterior of the housing to the open chamber.

The pump may be connected to the open line in addition to the close line. In this case, the control apparatus advantageously includes a further valve which is movable from an open configuration in which flow of fluid from the pump to the close line is permitted whilst flow of fluid from the pump to the open line is substantially prevented, and a closed configuration in which flow of fluid from the pump to the open line is permitted whilst flow of fluid from the pump to the close line is substantially prevented.

The open line may be provided with an exhaust valve which is located adjacent to the housing, and which is movable between a first position in which flow of fluid along the open line into the open chamber is permitted, and a second position in which the open line is substantially blocked upstream of the exhaust valve relative to the open chamber, and the open chamber is connected to a low pressure region.

The low pressure region may be the atmosphere at the exterior of the housing.

The low pressure region may comprise an exhaust conduit which has a greater cross-sectional area than the open line, and which is connected to a fluid reservoir.

The close line may be at least 2 inches in diameter.

The open line may be at least 2 inches in diameter.

According to a second aspect of the invention we provide a blow out preventer assembly comprising a blow out preventer and control apparatus, the blowout preventer comprising a housing, a sealing element, and a fluid pressure operated actuator mounted in the housing, the actuator dividing the interior of the housing into two chambers, namely an open chamber and a close chamber, substantially preventing flow of fluid between the two chambers, and being movable, by means of the supply of pressurised fluid to the close chamber, to urge the sealing element into sealing engagement with a drill pipe extending through the blow out preventer, the control apparatus including an open line which extends from the exterior of the housing to the open chamber wherein the control apparatus further includes an exhaust valve which is located adjacent to the housing, and which is movable between a first position in which flow of fluid along the open line into the open chamber is permitted, and a second position in which the open line is substantially blocked upstream of the exhaust valve relative to the open chamber, and the open chamber is connected to a low pressure region.

The low pressure region may be the atmosphere at the exterior of the housing.

The low pressure region may comprise an exhaust conduit which has a greater cross-sectional area than the open line, and which is connected to a fluid reservoir.

The blow out preventer assembly according to the second aspect of the invention may have any of the features of the blowout preventer assembly according to the first aspect of the invention.

According to a third aspect of the invention we provide a riser assembly comprising a riser and a blowout preventer assembly according to the first or second aspect of the invention, the blowout preventer being mounted on an uppermost end of the riser, wherein the source of pressurised fluid is mounted on the riser adjacent to the blowout preventer.

The riser assembly may further include a flow spool which is mounted on the upper end of the riser between the blowout preventer and the riser. In this case, the source of pressurised fluid may be mounted on (preferably at the bottom of) or below the flow spool.

Preferably the length of the close line between the source of pressurised fluid and the close chamber is less than 15 ft.

BRIEF DESCRIPTION OF THE DRAWINGS

Embodiments of the invention will now be described, by way of example only, with reference to the following figures.

DESCRIPTION OF THE PREFERRED EMBODIMENTS OF THE INVENTION

Figure 1:
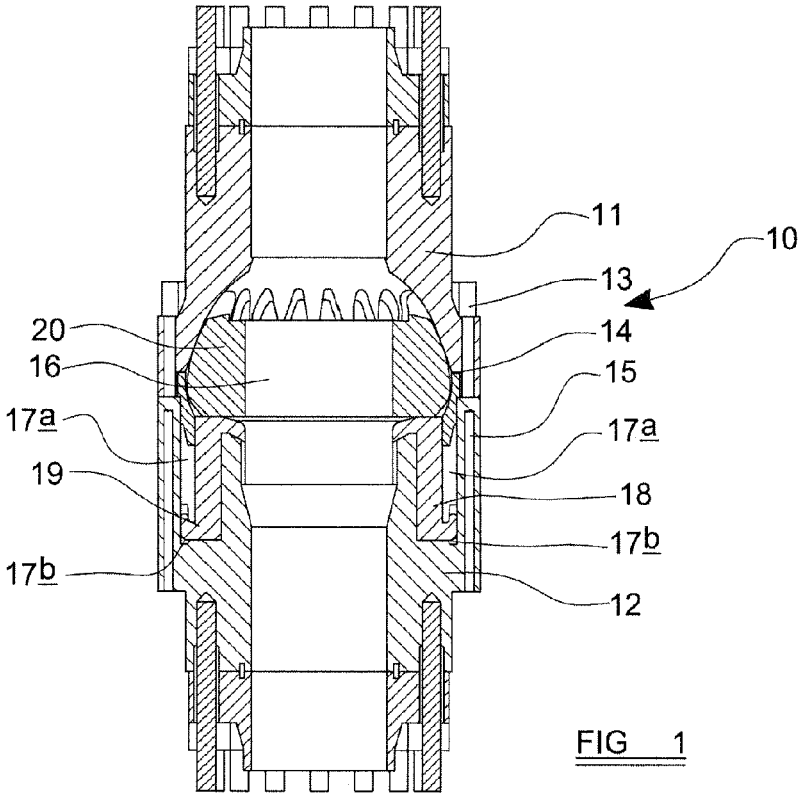
FIG. 1 shows an illustration of a longitudinal cross-section through one embodiment of BOP suitable for use in the invention.

Referring now to FIG. 1, there is shown a blowout preventer (BOP) 10, which comprises a housing which has a longitudinal axis and which is divided in a first housing part 11 and a second housing part 12, movement of the first housing part 11 relative to the second housing part 12 being prevented by fasteners 13, each fastener including a shaft which extends through a fastener receiving passage 14 provided in the first housing part 11 into a fastener receiving passage 15 provided in the second housing part. The housing is also provided with fluid flow passages 16 which extend from the first part of the housing 11 to the second part of the housing 12, and which, in this example, are each interspersed between two adjacent fasteners 13.

Located within the housing is a sealing element 20, which in this example comprises a torus shaped packing element made from an elastomeric material such as rubber with metallic inserts, and a fluid pressure operated actuator, in this example a piston 18. The piston 18 divides the interior of the housing into two chambers (an "open chamber 17*a*" and a "close chamber 17*b*"), and substantially prevents flow of fluid between the two chambers 17*a*, 17*b*.

This configuration of BOP is described in more detail in our co-pending UK patent application, GB 1104885.7, the contents of which is incorporated herein by reference. It should be appreciated that the invention is not restricted to use in conjunction with this type of BOP. The invention may be used with any type of fluid pressure operated BOP—whether an annular, a spherical or a ram BOP.

The piston 18 is movable, by means of the supply of pressurised fluid to the close chamber 17*b*, to push the packing element 20 against a curved portion of the first housing part, which causes the packing element 20 to be compressed and its diameter to reduce. When a drill pipe is located in the BOP 10, this causes the packing element 20 to constrict around and enter into sealing engagement with the drill pipe. Where no drill pipe is present, if sufficient pressure is applied to the close chamber 17*b*, the packing element 20 may be compressed so much that its central aperture disappears and it acts as a plug, preventing flow of fluid through the BOP 10. In either case, the BOP is in its closed position. The packing element 20 is released from sealing element from sealing engagement with the drill pipe or itself by the supply of pressurised fluid to the open chamber 17*a*.

Figure 2:
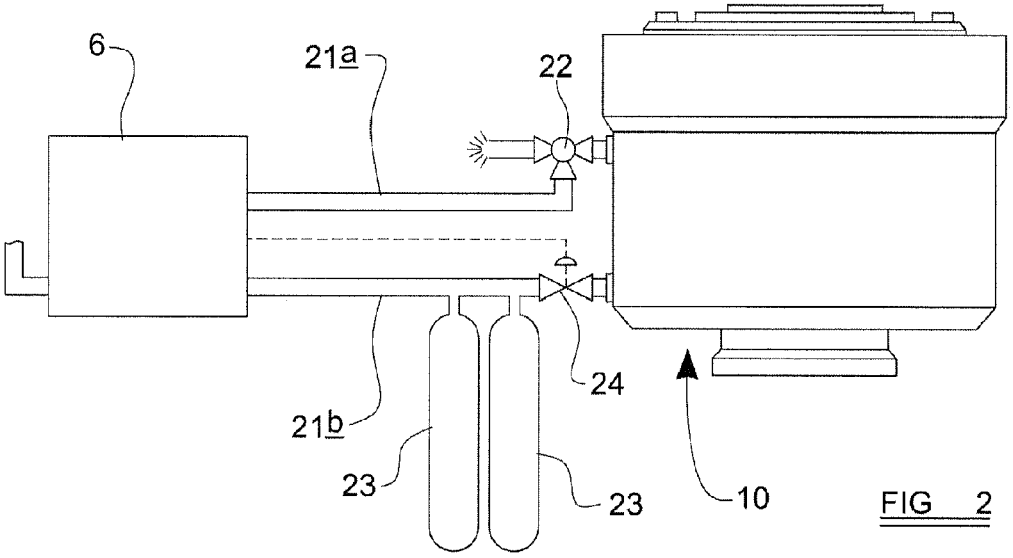
FIG. 2 shows a schematic illustration of an embodiment of BOP and BOP control system according to the invention.

Referring now to FIG. 2, there is shown an open line 21*a* which is connected to the open chamber 17*a* via one of the fluid flow passages 15 through the second housing part 12. There is also shown a close line 21*b* which is connected to the close chamber 17*b* via another one of the fluid flow passages 15. Preferably the close line 21*b* is a relatively large bore conduit (2 inches and above). The open line 21*a* is may also be similarly sized.

The fluid flow passages 15 in the BOP housing are typically 1 inch in diameter, so to give the connection between the open chamber 17*a* or the close chamber 17*b* and the lines 21*a*, 21*b* at the exterior of the housing the equivalent flow area to a 2 inch diameter, four fluid flow passages may be manifolded together for each of the open and close lines 21*a*, 21*b*. Alternatively, each of the fluid flow passages may be connected to a separate open or close line of smaller than 2 inches in diameter (1 inch diameter, for example), the total flow area provided by all the open or close lines being greater than or equal to the flow area provided by a single 2 inch diameter pipe.

A quick dump shuttle valve 22 is provided in the open line 21*a* directly adjacent the BOP housing. This valve 22 has a vent to atmosphere, and is a three-way shuttle valve which is movable between a first position in which fluid flow along the open line 21*a* is permitted, and a second position in which the open chamber 17*a* is connected to the vent to atmosphere.

Typically, the quick dump shuttle valve 22 is biased (advantageously by means of a spring) into the second position, and moves against the biasing force into the first position when there is sufficient pressure in the open line 21*a*.

An electrically or electronically operable close control valve 24 is provided in the close line 21*b* directly adjacent the BOP housing. This valve 24 is movable (for example by means of a solenoid or piezoelectric element) between a closed position in which flow of fluid along the close line 21*b* is substantially prevented, and an open position, in which flow of fluid along the close line 21*b* is permitted. Preferably, biasing means is provided to bias the valve 24 to the closed position, and supply of electrical current to the valve 24 causes the valve 24 to move to the open position.

Control of the supply of electrical current to the close control valve 24 is carried out by an electronic control unit in a hydraulic BOP control system 6 which is located remotely from the BOP 10, typically in a BOP control room.

The control system 6 also comprises a pump which is operable to draw fluid from a fluid reservoir and which is connected, via a valve or plurality of valves, to the open line 21*a* and the close line 21*b*. In preferred embodiment of the invention, the fluid is a non-corrosive, non-foaming environmentally-friendly fluid such as water containing a small amount of corrosion inhibitor. A non-return valve is provided in each of the open line 21*a* and close line 21*b* to prevent back flow of fluid towards the pump.

The valves of the control system 6 are electrically or electronically operable to direct fluid from the pump to either the open line 21*a* or the close line 21*b*. Preferably, operation of this valve or valves is controlled by the electronic control unit which controls operation of the close control valve 24.

Two accumulators 23 are provided in the close line 21*b*, close to or directly adjacent the close control valve 24. For a land installation, this means that the accumulators are as close to the BOP housing as reasonably practicable, bearing in mind limitations of pressurised accumulator bottles in a fire situation. For an off-shore installation, the accumulators are preferably no more than 15 ft from the close chamber.

These accumulators 23 are of conventional construction, and in this embodiment of the invention comprise a bottle, the interior of which is divided into two chambers by a diaphragm. The chamber at the closed end of the bottle is filled with an inert gas, and the other chamber is connected to the close line 21*b*. Thus, operating the control system 6 to pump fluid along the control line 21*b* whilst the close control valve 24 is in the closed position will cause pressurised fluid to be stored in the accumulators 23.

It should be appreciated, of course, that one or more than two accumulators 23 may equally be provided.

During normal use, the quick dump shuttle valve 22 is in its second position, i.e. with the open chamber 17*a* venting to atmosphere, the accumulators 23 are pressurised to a predetermined pressure, the close control valve 24 is in its closed position, the pump is inactive, and the valves in the control system 6 are arranged such that the pump output is connected to the close line 21*b*. If a kick is detected in the well bore, and it is necessary to close the BOP 10, the electronic control unit of the control system 6 is programmed to operate the close control valve 24 to move it to its open position, and to activate the pump to pump fluid along the close line 21*b*. Pressurised fluid is thus supplied to the close chamber 17*b* of the BOP 10, which then moves to its closed position, whilst the fluid expelled from the open chamber 17*a* is vented to atmosphere at the quick dump shuttle valve 22.

By positioning the accumulators close to the BOP, and using a relatively large diameter close line 21*b*, there is minimal time delay after the opening of the close control valve 24 before the pressurised fluid starts to reach the close chamber 17*b*. Moreover, using a relatively large diameter open line 21*a*, and venting the open chamber 17*a* to atmosphere at the quick dump shuttle valve 22 minimises the resistance exerted by the fluid in the open chamber 17*a* opposing this movement of the piston 18.

These factors combined means that particularly rapid closing of the BOP 10 can be achieved. In fact, for BOP 10 with an outer diameter of 46.5 inches and a 21¼ inch inner diameter mounted around a 5 inch drill pipe, complete closing of the BOP 10 can be achieved in 3 seconds or less. The closing time can be reduced by increasing the number of accumulators 23 in the close line 21*b*. This quick response time is highly desirable since most oil and gas exploration companies have policies to advocate the "Hard shut in" method. The main advantage of using the hard shut-in method is that the well is shut in with no delay, resulting in less formation fluid entering the well, and a lower shut in casing pressure.

To open the BOP 10, the electronic control unit of the control system 6 is programmed to operate the valves in the control system 6 to connect the pump output to the open line, and to activate the pump. Pressurised fluid is thus supplied to the open chamber 17*a*, and the piston moves back to return the BOP 10 to its open position. The fluid from the close chamber 17*b* is returned to the reservoir via the control system 6.

In an alternative embodiment of the invention, rather than venting to atmosphere, the vent of the quick dump shuttle valve 22 may be connected to a fluid reservoir (which may be the reservoir from which the pump draws fluid) via a pipe which has a significantly larger diameter than the open line 21*a* and the close line 21*b*. By using a relatively large diameter pipe, flow of fluid out of the open chamber 17*a* is relatively unimpeded, and, again, there is little resistance to movement of the piston 18 to the closed position. This embodiment of the invention may be preferred where the BOP 10 is used on a land-based drilling rig, rather than offshore.

Figure 3:
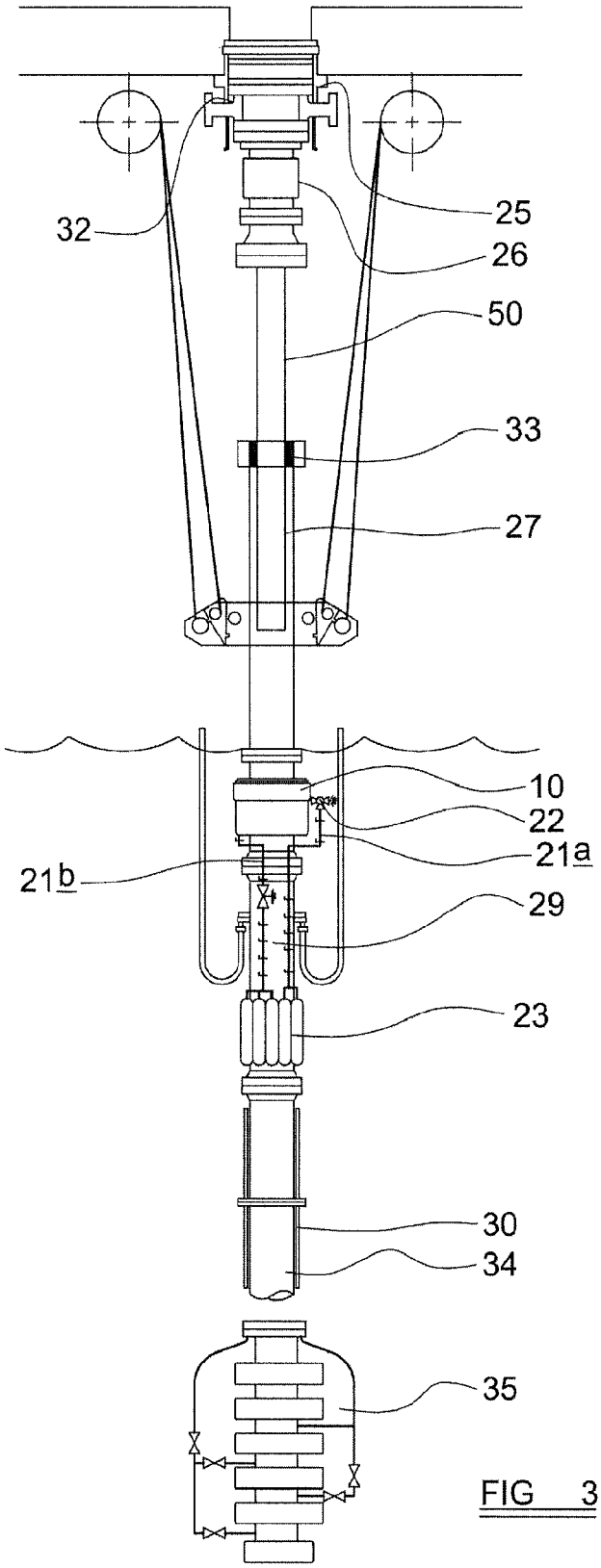
FIG. 3 shows an illustration of an offshore drilling system including a BOP and BOP control system according to the invention.

Referring now to FIG. 3, there is shown a low pressure upper marine riser package of a floating drilling rig including an embodiment of BOP 10 according to the invention. This includes a diverter assembly 25 for diverting uncontrolled gas and drilling mud from the riser annulus; an upper flex joint 26 for allowing tilting motion between a rig and a riser, and a self-tensioning slip joint 27 for compensating vertical motion between a subsea well and a floating drilling rig. The BOP 10 is located below the slip joint 27 and above a flowspool assembly 29. The BOP 10 and flow spool assembly 29 are considered as part of the riser string 30 and deployed through the rig's rotary system in the same manner. It will normally be situated just beneath the water line and splash zone. Further subsea BOPs 35 are also provided in a stack mounted on the wellhead.

In this example, the accumulators 23 (in this example there are more than two of them) are mounted on the riser at the base of the flowspool assembly 29. The accumulators 23 are positioned such that the length of the close line 21*b* between the accumulators 23 and the close chamber 17*b* does not exceed around 15 ft.

The open line 21*a* and close line 21*b* comprise large (at least 2 inch diameter) rigid conduit lines that run from the hydraulic BOP control system (not shown) mounted on the rig floor parallel to the flowspool body 29. The close line 21*b* comprises large (at least 2 inch diameter) rigid conduit lines that run parallel to the flowspool body to the close chambers of the BOP to assure fast actuation. The open line can be 2" in diameter as well, but need not be, particularly if it is also provided with a quick dump valve to release fluid from the open chamber to atmosphere, rather than return it to reservoir via the control system 6.

The inventive BOP 10 may also safely route entrapped gas from the riser 30 to a riser gas handling or choke manifold, where it the gas can be circulated out in a controller manner. Diverter assemblies 25 are not designed to close in on a riser and on many deepwater drilling rigs, they are rated to very low working pressure (500 psi) which is insufficient for riser kill operation. The inventive BOP 10 has several advantages over the diverter packer 32; that the slip joint packer seals 33 are not exposed to increased pressure for any extended time, that it closes faster than the diverter packer 32, that it is has a higher pressure rating than diverter assembly 25 which allows back pressure to be applied by a choke or back pressure valve on a choke manifold.

In the prior art, the diverter 25 situated above the slip joint 27 is used as a safety system to re-route entrapped gas in the wellbore fluid away from the rig. The gas travels up the riser, via the slip joint and is diverted overboard. This arrangement requires the slip joint packers to seal against the wellbore pressure which may led to catastrophic failure of packer elements and loss of containment and pollution if oil based drilling fluids are used. Since under normal drilling situation, the slip joint packers 33 are energized to seal against the hydrostatic pressure of the wellbore fluid between the slip joint packer 33 and the diverter 25 which is minimal. It is not designed to seal against wellbore pressure and typically some seepage is allowed to lubricate the slip joint 27.

When the actuator of the inventive BOP 10 moves to close the sealing element around a drill pipe, it acts as a blowout preventer and protects the low pressure diverter system above it. Moreover, provision of the inventive BOP 10 beneath the slip joint 27 negates this necessity of the slip joint packers 33 to seal against wellbore pressure.

When a well kick is detected during drilling, the mud pumps which are pumping mud down the drill string 50 are stopped. The well is secured immediately by closing the BOP 10 as described above. The subsea BOPs are then closed, but are allowed by regulation to take up to 15 times longer to close as compared to the inventive BOP 10. Pressures are monitored, and circulation of influx out of the riser can commence. After circulation of the influx, the pumps are shut down for a flow check. If there is no flow in the riser, the subsea BOPs 35 can be opened to monitor the wellbore for any signs of further flow.

Figure 4:
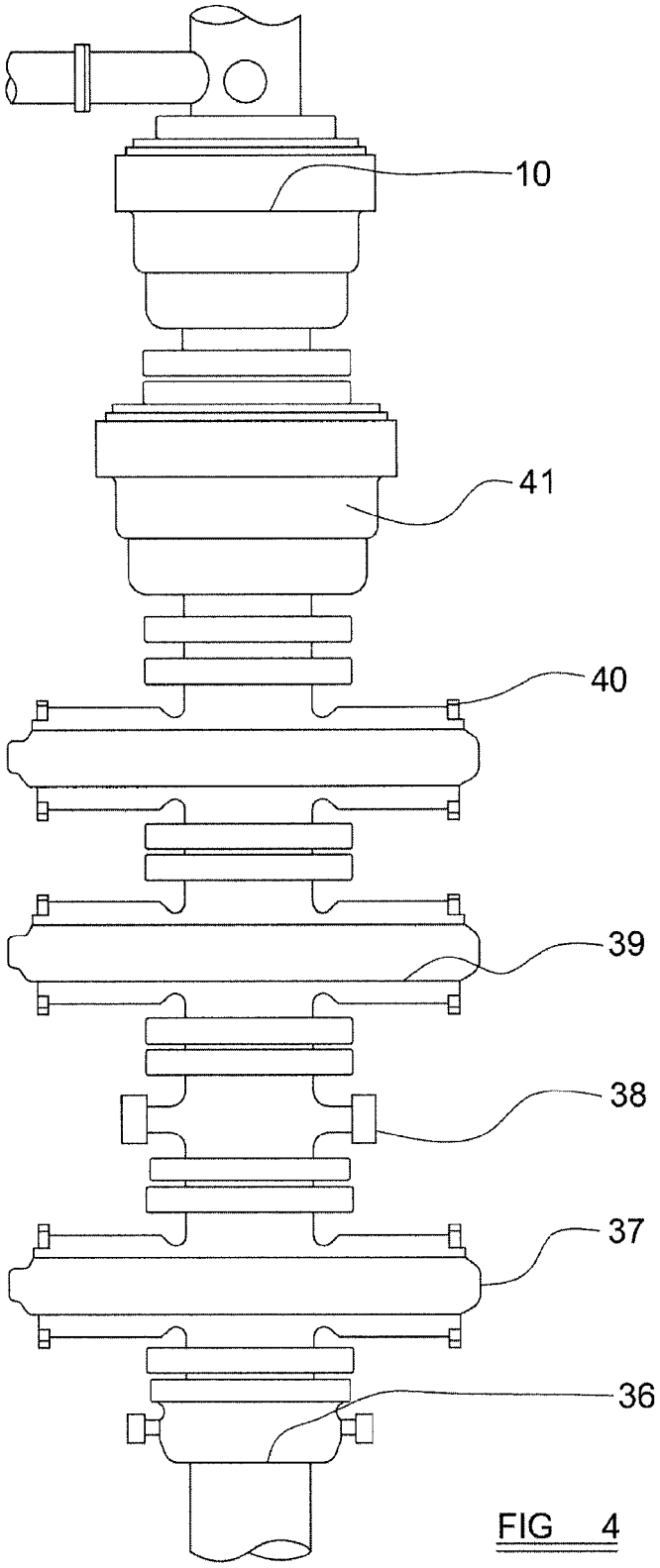
FIG. 4 shows an illustration of a surface BOP stack including a BOP and BOP control system according to the invention.

Referring now to FIG. 4, this shows an alternative use for a BOP 10 according to the invention. In this, the BOP 10 is installed directly above a surface BOP stack mounted on a wellhead 36. In this example, the BOP stack comprises, running from the wellhead 36 upwards, a ram BOP 37, a spool 38, further ram BOPs 39, 40, a conventional annular BOP 41, and the inventive BOP 10. A BOP according to the invention can, however, be installed on any surface BOP stack.

It is also envisioned that the conventional annular BOP 41 could be completely replaced by a further inventive BOP 10 with the appropriate pressure rating for that service.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A blowout preventer assembly comprising a blowout preventer and control apparatus, the blowout preventer comprising a housing, a sealing element, and a fluid pressure operated actuator mounted in the housing, the actuator dividing the interior of the housing into an open chamber and a close chamber, substantially preventing flow of fluid between the two chambers, and being movable, by supplying pressurised fluid to the close chamber, to urge the sealing element into sealing engagement with a drill pipe extending through the blow out preventer, the control apparatus including a close line which extends from the exterior of the housing to the close chamber, and a source of pressurised fluid which is connected to the close line, wherein the source of pressurised fluid is located adjacent to the housing, the control apparatus further comprising an open line which extends from the exterior of the housing to the open chamber, wherein the open line is provided with an exhaust valve which is located adjacent to the housing, and which is movable between a first position in which flow of fluid along the open line into the open chamber is permitted, and a second position in which the open line is substantially blocked upstream of the exhaust valve relative to the open chamber, and the open chamber is connected to a low pressure region.

2. A blowout preventer assembly according to claim 1 wherein the source of pressurised fluid comprises at least one accumulator.

3. A blowout preventer assembly according to claim 1 wherein the control apparatus further comprises a close control valve which is located in the close line between the source of pressurised fluid and the close chamber, the close control valve being movable between an open position in which flow of fluid from the source of pressurised fluid to the close chamber is permitted, and a closed position in which flow of fluid from the source of pressurised fluid to the close chamber is substantially prevented.

4. A blowout preventer assembly according to claim 3 wherein the close control valve is electrically operable.

5. A blowout preventer assembly according to claim 4 wherein the control valve moves from the close position to the open position when supplied with electrical power.

6. A blowout preventer assembly according to claim 5 wherein the control apparatus further comprises an electronic control unit which is remote from the blow out preventer and control apparatus, and supply of electrical power to the close control valve is controlled by the electronic control unit.

7. A blowout preventer assembly according to claim 1 wherein the control apparatus further comprises a pump which has an inlet which draws fluid from a fluid reservoir and an outlet which is connected to the close line.

8. A blowout preventer assembly according to claim 1 wherein the control apparatus further comprises a pump, the pump being connected to the open line in addition to the close line.

9. A blowout preventer assembly according to claim 8 wherein the control apparatus advantageously includes a further valve which is movable from an open configuration in which flow of fluid from the pump to the close line is permitted whilst flow of fluid from the pump to the open line is substantially prevented, and a closed configuration in which flow of fluid from the pump to the open line is permitted whilst flow of fluid from the pump to the close line is substantially prevented.

10. A blowout preventer assembly according to claim 1 wherein the low pressure region is the atmosphere at the exterior of the housing.

11. A blowout preventer assembly according to claim 1 wherein the low pressure region comprises an exhaust conduit which has a greater cross-sectional area than the open line, and which is connected to a fluid reservoir.

12. A blowout preventer assembly according to claim 1 wherein the close line is at least 2 inches in diameter.

13. A blowout preventer assembly according to claim 1 wherein the close line comprises a plurality of pipes which together provide a flow area equal to or greater than that provided by a single 2 inch diameter cylindrical pipe.

14. A blowout preventer assembly according to claim 1 wherein the open line is at least 2 inches in diameter.

15. A blowout preventer assembly according to claim 1 wherein the open line comprises a plurality of pipes which together provide a flow area equal to or greater than that provided by a single 2 inch diameter cylindrical pipe.

16. A riser assembly comprising a riser and a blowout preventer assembly according to claim 1, the blowout preventer being mounted on an uppermost end of the riser, wherein the source of pressurised fluid is mounted on the riser adjacent to the blowout preventer.

17. A riser assembly according to claim 16 further including a flow spool which is mounted on the upper end of the riser between the blowout preventer and the riser.

18. A riser assembly according to claim 17 wherein the source of pressurised fluid is mounted on the flow spool.

19. A riser assembly according to claim 17 the riser including a slip joint, the blowout preventer being mounted below the slip joint.

* * * * *